United States Patent [19]

Maruyama et al.

[11] Patent Number: 4,883,095

[45] Date of Patent: Nov. 28, 1989

[54] CONNECTING CONSTRUCTION FOR SIDESTAY OF HEALD FRAME AND TRANSVERSE BEAM

[75] Inventors: Setsu Maruyama, Sakai; Kiyoshi Takei, Toyonaka, both of Japan

[73] Assignee: Maruyama Mfg. Co., Ltd., Sakai, Japan

[21] Appl. No.: 128,646

[22] Filed: Dec. 4, 1987

[30] Foreign Application Priority Data

Oct. 30, 1987 [JP] Japan ..... 62-167574

[51] Int. Cl.[4] ..... D03C 9/06

[52] U.S. Cl. ..... 139/91

[58] Field of Search ..... 139/91, 92

[56] References Cited

U.S. PATENT DOCUMENTS 4,022,252 3/1977 Ogura ..... 139/91

4,552,185 11/1985 Graf ..... 139/91

FOREIGN PATENT DOCUMENTS 446221 3/1968 Switzerland ..... 139/91

*Primary Examiner*—Henry S. Jaudon

*Attorney, Agent, or Firm*—Gifford, Groh, Sheridan, Sprinkle and Dolgorukov

[57] ABSTRACT

A connecting construction for a sidestay of a heald frame and a transverse beam having a sidestay of a heald frame, a transverse beam to be connected via an end face thereof with the sidestay, a concave engagement space defined in the end face of the transverse beam, a projecting portion formed integrally with the sidestay to be inserted into the concave engagement space and a securing device for pressingly securing a peripheral wall of the concave engagement space to the projecting portion in a longitudinal direction of the sidestay. The securing device includes a wedge-shaped securing member provided at an interspace formed between an outer face and a peripheral wall face facing each other of outer faces of the projecting portion and peripheral wall faces respectively opposed to each other in a longitudinal direction of the sidestay, the wedge-shaped securing member having contact faces respectively in contact with the outer face and the peripheral wall face, and an operative member for moving the securing member along the transverse beam to secure the former to the latter.

4 Claims, 2 Drawing Sheets

CONNECTING CONSTRUCTION FOR SIDESTAY OF HEALD FRAME AND TRANSVERSE BEAM

BACKGROUND OF THE INVENTION

1. Field of the Invention

The present invention relates to a connecting construction for a sidestay of heald frame and a transverse beam of a weaving machine, and more particularly to a connecting construction of the above type in which the sidestay integrally forms a projecting portion for connecting to be inserted into a concave engagement space defined in an end face of the transverse beam with the projecting portion including means for pressingly securing a peripheral wall of the concave engagement space in a longitudinal direction of the sidestay.

2. Description of the Prior Art

A conventional connecting construction of the above-described type employs the securing means having a construction as shown in FIG. 4. That is, a projecting portion 7' of the sidestay 1 has a forked shape and opposing inner faces 7C and 7D of two legs *7a, 7b* of this projecting portion 7' are inclined to become gradually adjacent to each other towards the sidestay 1. Between the legs *7a* and *7b*, there is provided a wedge-shaped securing member 9' slidable with respect to the opposing inner faces 7C, 7D. The legs *7a* and *7b* are deformed at roots thereof with a movement of the securing member 9' towards the sidestay 1, and outer faces 7E, 7F of the legs *7a, 7b* are secured by means of a bolt 11' to peripheral wall faces 6A, 6B opposing to each other in the longitudinal direction of the sidestay of the concave engagement space 6 defined in the transverse beam 2 (e.g. a Japanese utility model application published under SHOWA 51-13578).

However, in the case of the above-described conventional construction, for pressingly bolt-securing the legs to the peripheral wall faces with the movement of the securing member towards the sidestay, the legs per se need to be deformed. Therefore, there tends to occur irregularities in the amount of deformation of the legs due to inevitable manufacturing errors e.g. in a distance in the sidestay longitudinal direction between the two legs and in an inclination angle of the opposing inner faces. These irregularities result in errors in an attaching postion of the transverse beam in the sidestay longitudinal direction, and moreover there occur such inconveniences to be described hereinafter.

As shown in FIG: 2, in the heald frame, it has been necessary to set with a high precision a distance 'D' between a pair of upper and lower heald rods 4 extending in between the right and left sidestays 1, 1 with a tolerance of 1.0 to 1.5 mm in the case of a high speed weaving machine. Since positions of the heald rods 4 in the sidestay longitudinal direction are regulated by middle hook hangers 5 for supporting intermediate portions of the heald rods 4 to a transverse beams 2, the distance 'D' varies depending on the attaching positions of the transverse beams 2 in the sidestay longitudinal direction. As the result, if there are irregularities in the attaching positions of the beams 2 in the sideway longitudinal direction as is the case with the conventional construction, it is impossible to set the distance 'D' with a high precision.

Furthermore, in the heald frame, with vertical movements attendant with a rotation of the weaving machine, there occurs an inertia force which tends to bend the transverse beam 2 into an arch repeatedly, as shown in FIGS. 3(*a*) and 3(*b*), providing a bending moment to a connecting portion between the sidestay and the transverse beam. This bending moment is especially large in the case of a high speed or super high speed weaving machine. Therefore, with the conventional construction, since the legs are secured with deformation, contact pressure between the outer faces of the legs and the peripheral wall faces varies from one plane to another, certain portions of the outer faces and the peripheral wall faces are more subjected to stress than the rest portions of the same each time the bending moment acts thereon, and consequently, due to the deformation of the outer faces and the peripheral wall faces, there tends to occur looseness or damage in the connecting portion between the sidestay and the transverse beam.

SUMMARY OF THE INVENTION

The object of the present invention is to solve all of the above problems of the prior art.

In order to accomplish the above object, according to a connecting construction for a sidestay and a transverse beam of a heald frame related to the present invention, the connecting construction comprises a sidestay of the heald frame, a transverse beam to be connected via an end face thereof with the sidestay, a concave engagement space defined in the end face of the transverse beam, a projecting portion formed integrally with the sidestay to be inserted into the concave engagement space and securing means for pressingly securing a peripheral wall of the concave engagement space to the projecting portion in a longitudinal direction of the sidestay. The securing means includes a wedge-shaped securing member and operative means, the securing member being provided at an interspace formed between an outer face and a peripheral wall face facing each other of outer faces of the projecting portion and peripheral wall faces respectively opposed to each other in a longitudinal direction of the sidestay, the wedge-shaped securing member having contact faces respectively in contact with the outer face and the peripheral wall face, and the operative means moving the securing member along the transverse beam to secure the former to the latter.

Functions and effects of the above construction are as follows.

As the securing member is moved by the operative means towards the sidestay to move the transverse beam parallel to the projecting portion of the sidestay in the longitudinal direction of the same, the projecting portion and the peripheral wall face of the transverse beam are pressingly secured to each other in the sidestay longitudinal direction. In the press-securing operation, since the projecting portion need not be deformed, it is possible to maintain constant the position of the outer face of the projecting portion in the sidestay longitudinal direction which serves as a reference for an attaching position of the transverse beam in the sidestay longitudinal direction. Moreover, since the movement of the transverse beam for the press-securing is the parallel movement, the face contact in the sidestay longitudinal direction between the projecting portion and the peripheral wall may be reliably maintained.

As the result, according to the present invention, it has become possible to attach the transverse beam in the sidestay longitudinal direction with an improved precision which affects the precision in the distance between the heald rod and the heald and also to improve the durability of the connecting construction. Therefore, the present invention has achieved a useful connecting construction for the sidestay and the transverse beam of a heald frame especially of a high speed or a super high speed weaving machine.

BRIEF DESCRIPTION OF THE DRAWINGS

FIGS. 1 through 3 show preferred embodiments of a connecting construction of a sidestay and a transverse beam of a heald frame related to the present invention, in which:

FIG. 1 is a vertically sectional front view showing the major portion in an enlarged scale, FIG. 2 is a front view, FIGS. 3(*a*) and 3(*b*) are schematic views illustrating deformed conditions of the heal frame.

DETAILED DESCRIPTION OF THE PREFERRED EMBODIMENTS

Preferred embodiments of the present invention will be particularly described hereinafter.

Figure 2:
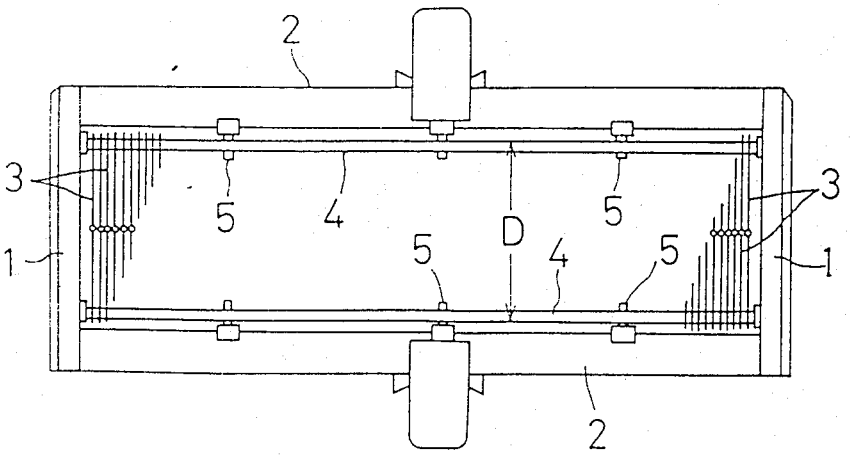

As shown in FIG. 2, a heald frame for a high speed or a super high speed weaving machine comprises a pair of upper and lower cylindrical transverse beams 2 and a pair of upper and lower heald rods 4 for extending healds 3 thereon, the beams and the rods extending between a pair of right and left sidestays 1. A longitudinally intermediate portion of the heald rod 4 is supported via a middle hook hanger by the transverse beam 2.

Figure 1:
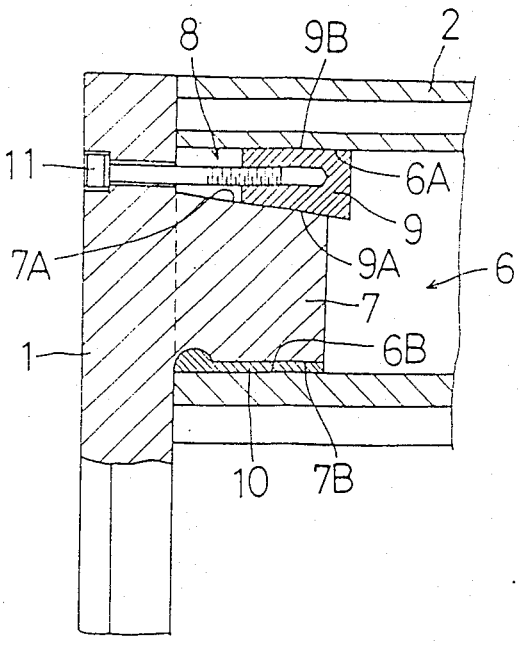

Referring to a connecting construction for the side stays 1 and the transverse beams 2, as shown now in FIG. 1, the sidestay 1 integrally forms a projecting portion 7 for connecting to be inserted into a concave engagement space 6 defined in an end face of the transverse beam 2 (i.e. inside an end of the transverse beam). Further, there is provided securing means for pressingly securing the peripheral wall of the concave engagement space 6 to the projecting portion 7, as the peripheral wall of the concave engagement space 6 is pressingly secured to the projecting portion 7, the sidestay 1 and the transverse beam 2 are connected with each other with an attaching position of the transverse beam 2 to the sidestay 1 being regulated and detachment of the transverse beam 2 from the sidestay 1 being prevented by the press-securing.

The securing means includes a securing member 9 provided at an interspace 8 formed between an outer face 7A and a peripheral wall face 6A facing each other of outer faces 7A, 7B of the projecting portion 7 and peripheral wall faces 6A, 6B respectively opposed to each other in a longitudinal direction of the sidestay and the securing means further includes operative means 11 for moving the securing member 9 along the transverse beam 2 to secure the former to the latter. The other outer face 7B of the projecting portion 7 and the two peripheral wall faces 6A and 6B are formed respectively along a longitudinal direction of the transverse beam. On the other hand, the outer face 7A is formed with an inclination to become gradually adjacent with the opposing peripheral wall face 6A towards the sidestay 1. The securing member 9 is wedge-shaped and has contact faces 9A and 9B respectively for the outer face 7A and the peripheral wall faced 6A opposing to each other across the member 9. Further, there is provided a plate type spacer 10 between the other outer face 7B and the peripheral wall face 6B.

Figure 3A:
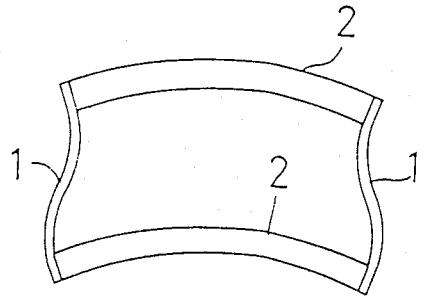
Figure 3B:
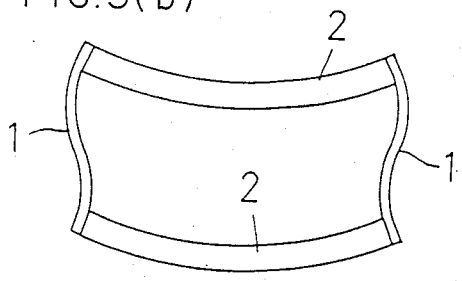
Figure 4:
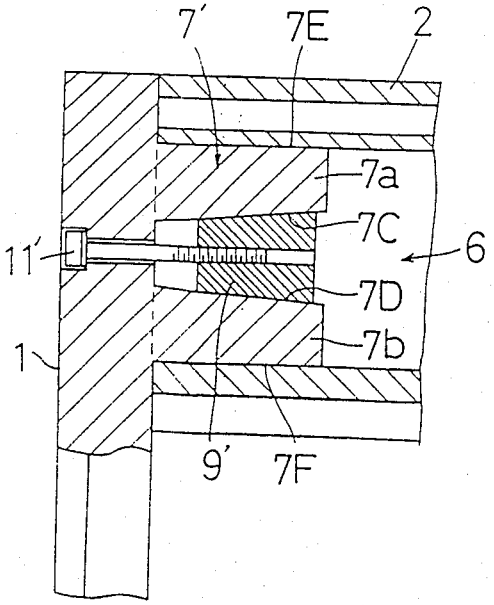
FIG. 4 (PRIOR ART)
FIG. 4 is a view showing a conventional connecting construction for a sidestay and a transverse beam of a heald frame.

That is to say, the securing means moves the transvese beam 2 to one side in the sidestay longitudinal direction with respect to the projecting portion 7 with the operative means 11 moving the securing member 9 towards the sidestay 1, whereby the other peripheral wall face 6B of the transverse beam 2 is pressingly secured via the spacer 10 to the other outer face 7B of the projecting portion 7. And, an attaching position of the transverse beam 2 in the sidestay longitudinal direction is adjustable by varying the thickness of the spacer 10 in accordance with the other outer face 7B of the projecting portion 7. As the result, it is possible to properly set a distance 'D' between the pair of upper and lower heald rods 4. Also, since the transverse beam 2 moves in parallel along the longitudinal direction of the sidestay 1 in the above press-securing operation, the pressing between the outer face 7A of the projecting portion 7 and the peripheral wall face 6A through the securing member 9 and also the pressing between the other outer face 7B of the projecting portion 7 and the peripheral wall face 6B through the spacer 10 are both carried out with the respective faces maintaining mutual cotact therebetween. As the result, as shown in FIGS. 3(*a*) and 3(*b*), it is possible to firmly maintain the connection between the sidestay and the transverse beam 2 against the bending moment affecting the connecting portion therebetween caused when vertical movements of the heald frame attendant with a rotation of the weaving machine repeatedly bend the transverse beam 2 into an arch.

A specific example of the operative means 11 is a pulling type bolt which extends through the sidestay 1 without completely coming into the interspace 8 thereby screwing an end thereof projecting towards the interspace 8 side into the securing member 9.

The sidestay 1 and the transverse beam 2 are formed of aluminum or a resin and so on.

An alternate embodiment of the present invention will be described next.

In the previous embodiment, for forming the outer face 7A facing the interspace 8 with an inclination with respect to the peripheral wall face 6A, the peripheral wall face 6A is formed along the longitudinal direction of the transverse beam while the outerface 7A is inclined with respect to the same. Instead of this, it is also possible to incline both of the outer face 7A and the peripheral wall face 6A in the longitudinal direction of the transverse beam with the outer face 7A being inclined relative to the peripheral wall face 6A. Further, it is also possible to incline the peripheral wall face 6A with respect to the longitudinal direction of the transverse beam and at the same time to from the outer face 7A along the longitudinal direction of the transverse beam thereby inclining the outer face 7A relative to the peripheral wall face 6A.

What is claimed is:

1. A connecting construction for a sidestay of a heald frame and a transverse beam comprising:

a sidestay of a heald frame;

a transverse beam to be connected via an end face thereof with said sidestay;

a concave engagement space defined in the end face of said transverse beam;

a projecting portion formed integrally with said sidestay to be inserted into said concave engagement space;

securing means for pressingly securing a peripheral wall of said concave engagement space to said projecting portion in a longitudinal direction of said sidestay; wherein said securing means includes:

a wedge-shaped securing member provided at an interspace formed between one of two outer faces of said projecting portion and one of two peripheral wall faces of said concave engagement space, said one outer face of said projecting portion and said one peripheral wall face being opposed to each other in a longitudinal direction of said sidestay, said wedge-shaped securing member having contact faces respectively in contact with said one outer face and said one peripheral wall face, and operative means moving said securing member along said transverse beam to secure the sidestay to the transverse beam.

2. A connecting construction for a sidestay of a heald frame and a transverse beam, as defined in claim 1, wherein there is provided a plate type spacer between the other outer face and the other peripheral wall face.

3. A connecting construction for a sidestay of a heald frame and a transverse beam, as defined in claim 1, wherein said operative means is a pulling type bolt.

4. A connecting construction for a sidestay of a heald frame and a transverse beam comprising:

a sidestay of a heald frame;

a transverse beam to be connected at its end face to said sidestay;

a concave engagement space defined in the end face of said transverse beam between two opposed peripheral wall faces of said beam;

a projecting portion formed integrally with said sidestay and having two outer faces to be inserted into said concave engagement space with one of said two outer faces in contact with one of said two opposed peripheral wall faces;

securing means for pressingly securing a peripheral wall of said concave engagement space to said projecting portion in a longitudinal direction of said sidestay; wherein said securing means includes:

a wedge-shaped securing member provided at an interspace formed between the other of said two outer faces of said projecting portion and the other of said two peripheral wall faces of said concave engagement space, said wedge-shaped securing member having contact faces respectively in contact with said other outer face and said other peripheral wall face; and operative means moving said securing member along said transverse beam to increase the contact pressure between the contact faces of said wedge-shaped securing member and said one peripheral wall face and said one outer face on one side of said projecting portion and between said other peripheral wall face and said other outer face on the other side of said projecting portion.

* * * * *